US007510408B2

(12) United States Patent
Tsurumi

(10) Patent No.: US 7,510,408 B2
(45) Date of Patent: Mar. 31, 2009

(54) EARTHING STRUCTURE AND ELECTRICAL CONNECTOR USING THE SAME

(75) Inventor: Masahiko Tsurumi, Tokyo (JP)

(73) Assignee: DDK Ltd., Tokyo (JP)

( * ) Notice: Subject to any disclaimer, the term of this patent is extended or adjusted under 35 U.S.C. 154(b) by 31 days.

(21) Appl. No.: 11/787,253

(22) Filed: Apr. 13, 2007

(65) Prior Publication Data

US 2007/0249192 A1 Oct. 25, 2007

(30) Foreign Application Priority Data

Apr. 25, 2006 (JP) ..... 2006-119970

(51) Int. Cl.
*H01R 4/66* (2006.01)

(52) U.S. Cl. ..... 439/92; 439/680

(58) Field of Classification Search ..... 439/92, 439/95, 108, 680, 681, 939
See application file for complete search history.

(56) References Cited

U.S. PATENT DOCUMENTS 5,169,323 A * 12/1992 Kawai et al. ..... 439/95
5,240,424 A * 8/1993 Honma et al. ..... 439/95
6,394,856 B1 * 5/2002 Wertz ..... 439/681

FOREIGN PATENT DOCUMENTS

JP H07-82889 3/1995

* cited by examiner

*Primary Examiner*—Tho D Ta
*Assistant Examiner*—Travis Chambers
(74) *Attorney, Agent, or Firm*—Abelman, Frayne & Schwab

(57) ABSTRACT

A grounding structure is provided in an electrical connector, which includes contacts, a housing, a shell, and a ground terminal or a ground lug. The shell has a through-hole communicating with a fitting groove, an installing groove, and a connection portion groove, and the through-hole has an inserting groove into which the ground terminal is inserted, a screw portion for holding the ground terminal, a spacing groove for avoiding any interference with the ground lug integrally mounted on the housing, and an engaging portion to engage a locking portion of the housing. Both the ground lug and the ground terminal are constructed to become electrically conductive with the same shell, respectively, so that grounding is effected by either of the ground lug integrally mounted on the housing and the separately provided ground terminal. It is thus possible to select one contact or the separate ground terminal with respect to the same shell for grounding.

8 Claims, 8 Drawing Sheets

EARTHING STRUCTURE AND ELECTRICAL CONNECTOR USING THE SAME

BACKGROUND OF THE INVENTION

This invention relates to an earthing or grounding structure enabling both a ground terminal and a ground lug to be in continuity even with the same shell structure for grounding, and more particularly to an electrical connector using the grounding structure for use in machine tools, robots and the like.

A commonly used electrical connector at least includes a plurality of contacts, a housing for holding the contacts, and a shell for holding the housing. Moreover, said electrical connector has an earthing or grounding structure for causing a ground terminal or ground lug to be in continuity with said shell for connecting a protection circuit as a safety measure. An earthing (i.e., grounding) structure has been disclosed in the following Patent Literature 1 or the like.

Patent Literature 1

Claim 1 of Japanese Patent Application Publication No. H7-82,889 (1995) has disclosed a waterproof connector characterized comprising a shell, a rubber insulator detachably inserted in said shell, a plurality of relay contacts provided on said rubber insulator, press-fitting contacts each adapted to removably contact said relay contact, a ground lug mounted on either of said relay contact and said press-fitting contact to electrically contact said shell, a front insulator detachably inserted in said shell and holding the fitting of said relay contact and said press-fitting contact, a rear insulator detachably inserted in said shell and engaging said press-fitting contact to cause said press-fitting contact to be anchored to said front insulator, a retainer ring detachably anchored in said shell and causing said rear insulator to be anchored in said shell, and an O-ring detachably provided in said shell and adapted to abut against a mating connector.

In FIGS. 2 and 3 and the paragraph [0014] of the official gazette (Japanese Patent Application Publication No. H7-82, 889), concerning the grounding structure using a ground lug, there is described "The ground lug 9 is formed from square wires having a diameter of about 0.5 mm, and upon mounting the ground lug 9 on a relay pin 4', the ground lug 9 is secured at a part 9b to the relay pin 4' by pressure welding. When a rubber insulator 5 provided with the relay pin 4' is inserted into the shell 1 by press-fitting, a part 9a of the ground lug 9 is inserted into the shell 1 by press-fitting so that a chromate film on a zinc plating layer of the shell 1 is broken by the part 9a of the ground lug 9, thereby obtaining continuity between the ground lug 9 and the shell 1. Moreover, the contact resistance between the relay pin 4' and the shell 1 is less than 0.1Ω."

In order to comply with the safety standard, recently, the need to employ a reliable ground connection with a shell has been increased. For this purpose in many cases, as disclosed in the Patent Literature 1, one (core) of a required number of contacts is connected to a ground lug, and further the ground lug is brought into contact with a shell so as to obtain continuity between the one of the contacts and the shell, thereby achieving a grounding structure. However, one of the required number of contacts has to be used for the grounding so that a further contact must be complicatedly added to the required contacts.

Even if the use of one contact among the required ones for grounding is accepted, there has been an increasing customer's demand for a structure enabling contacts to be easily inserted into and removed from a housing and further enabling the housing to be simply inserted into and removed from a shell.

Depending upon customers or consumers, moreover, there have been demands for a grounding procedure being capable of suitably choosing by a user whether one contact among a required number of contacts or a separate ground terminal is used for grounding.

SUMMARY OF THE INVENTION

In view of these problems with the prior art, the invention has an object to provide a grounding structure and an electrical connector using the grounding structure, enabling simple insertion and removal of contacts with respect to a housing and the housing with respect to a shell, and further enabling suitable selection of whether one of the required number of contacts or a separate ground terminal is used with the same shell for grounding.

The object of the invention described above can be achieved by the grounding structure for an electrical connector 10 including a plurality of contacts 14, a housing 12 for arranging and holding said contacts 14, a shell 16 for holding said housing 12, and a ground terminal 20 of a required number or a ground lug 18 of a required number, said grounding structure for causing said ground terminal 20 or said ground lug 18 to be electrically conductive with said shell 16, in that according to the invention said shell 16 comprises a through-hole 48 communicating with a fitting groove 42 for a mating connector, an installing groove 44 for said housing, and a connection portion groove 46, and said through-hole 48 comprises an inserting groove 50 into which said ground terminal 20 is inserted, a screw portion 52 for holding said ground terminal 20, a spacing groove 51 for avoiding any interference with said ground lug 18 integrally mounted on said housing 12, and an engaging portion 53 to engage a locking portion 32 of said housing 12, and in that both said ground lug 18 and said ground terminal 20 are constructed to become electrically conductive with the same shell 16, respectively, so that grounding is effected by either of said ground lug 18 integrally mounted on said housing 12 and said separately provided ground terminal 20.

According to the grounding structure as claimed in claim 2, said grounding lug 18 and said shell 16 are so constructed that when said housing 12 having said ground lug 18 integrally mounted thereon is inserted into said shell 16 from the side of said connection portion groove 46 to cause said locking portion 32 of said housing 12 to engage said engaging portion 53 of said shell 16, said ground lug 18 and said shell 16 become electrically conductive with each other.

According to the grounding structure as claimed in claim 3, said ground terminal 20 and said shell 16 are so constructed that after said housing 12 is inserted into said shell 16 from the side of said connection portion groove 46 to cause the locking portion 32 of said housing 12 to engage the engaging portion 53 of said shell 16, said ground terminal 20 is inserted into said inserting groove 50 of said shell 16 and a set screw 24 is screwed into said screw portion 52 so that said ground terminal 20 and said shell 16 become electrically conductive with each other.

The object of the invention described above can be accomplished by the electrical connector 10 including a plurality of contacts 14, a housing 12 for arranging and holding said contacts 14, a shell 16 for holding said housing 12, and a ground terminal 20 of a required number or a ground lug 18 of a required number, and said shell 16 and said ground terminal 20 or said ground lug 18 being adapted to be electrically conductive with each other, in that according to the invention said shell 16 comprises a through-hole 48 communicating with a fitting groove 42 for a mating connector, an installing groove 44 for said housing 12, and a connection portion groove 46, and said through-hole 48 comprises an inserting groove 50 into which said ground terminal 20 is inserted, a screw portion 52 for holding said ground terminal 20, a spacing groove 51 for avoiding any interference with said ground lug 18 integrally mounted on said housing 12, and an engaging portion 53 to engage a locking portion 32 of said housing 12, and in that both said ground lug 18 and said ground terminal 20 are constructed to become electrically conductive with the same shell 16, respectively, so that grounding is effected by either of said ground lug 18 integrally mounted on said housing 12 and said separately provided ground terminal 20.

According to the electrical connector 10 as claimed in claim 5, said ground lug 18 and said shell 16 are so constructed that when said housing 12 having said ground lug 18 integrally mounted thereon is inserted into said shell 16 from the side of said connection portion groove 46 to cause said locking portion 32 of said housing 12 to engage said engaging portion 53 of said shell 16, said ground lug 18 and said shell 16 become electrically conductive with each other.

According to the electrical connector 10 as claimed in claim 6, said ground terminal 20 and said shell 16 are so constructed that after said housing 12 is inserted into said shell 16 from the side of said connection portion groove 46 to cause the locking portion 32 of said housing 12 to engage the engaging portion 53 of said shell 16, said ground terminal 20 is inserted into said inserting groove 50 of said shell 16 and a set screw 24 is screwed into said screw portion 52 so that said ground terminal 20 and said shell 16 become electrically conductive with each other.

According to the electrical connector 10 as claimed in claim 7, a key 66 having a groove 68 or a raised portion 72 is arranged at the center of a fitting portion of said housing 12, and a key 70 having a raised portion 72 or a groove 68 inversely with the first mentioned key is arranged on a mating connector at a location corresponding to said first mentioned key 66 so that the key 66 of said housing 12 and the key 70 of said mating connector are brought into engagement with each other, thereby preventing an erroneous insertion of the electrical connector 10 into the mating connector.

Further, according to the electrical connector 10 as claimed in claim 8, said key 66 is held in said housing 12 with the aid of means enabling said groove 66 or said raised portion 72 to be rotated.

As can be seen from the above description, the grounding structure according to the invention can bring about the following significant effects.

(1) In a grounding structure for an electrical connector 10 including a plurality of contacts 14, a housing 12 for arranging and holding said contacts 14, a shell 16 for holding said housing 12, and a ground terminal 20 of a required number or a ground lug 18 of a required number, said grounding structure for causing said ground terminal 20 or said ground lug 18 to be electrically conductive with said shell 16, according to the invention said shell 16 comprises a through-hole 48 communicating with a fitting groove 42 for a mating connector, an installing groove 44 for said housing, and a connection portion groove 46, and said through-hole 48 comprises an inserting groove 50 into which said ground terminal 20 is inserted, a screw portion 52 for holding said ground terminal 20, a spacing groove 51 for avoiding any interference with said ground lug 18 integrally mounted on said housing 12, and an engaging portion 53 to engage a locking portion 32 of said housing 12, and further according to the invention both said ground lug 18 and said ground terminal 20 are constructed to become electrically conductive with the same shell 16, respectively, so that grounding is effected by either of said ground lug 18 integrally mounted on said housing 12 and said separately provided ground terminal 20. Therefore, said contacts 14 and said housing 12 can be simply inserted and removed, and a customer or consumer can suitably choose whether one of a required number of contacts 14 or a separate ground terminal 20 is used for grounding structure with the same shell 16, thereby easily performing grounding.

(2) According to the grounding structure as claimed in claim 2, said ground lug 18 and said shell 16 are so constructed that when said housing 12 having said ground lug 18 integrally mounted thereon is inserted into said shell 16 from the side of said connection portion groove 46 to cause said locking portion 32 of said housing 12 to engage said engaging portion 53 of said shell 16, said ground lug 18 and said shell 16 become electrically conductive with each other. Consequently, said contacts 14 and said housing 12 can be simply inserted and removed, and one of a required number of contacts 14 can be used for grounding structure with the same shell 16, thereby easily performing grounding.

(3) According to the grounding structure as claimed in claim 3, said ground terminal 20 and said shell 16 are so constructed that after said housing 12 is inserted into said shell 16 from the side of said connection portion groove 46 to cause the locking portion 32 of said housing 12 to engage the engaging portion 53 of said shell 16, said ground terminal 20 is inserted into said inserting groove 50 of said shell 16 and a set screw 24 is screwed into said screw portion 52 so that said ground terminal 20 and said shell 16 become electrically conductive with each other. Accordingly, said contacts 14 and said housing 12 can be simply inserted and removed, and a separate ground terminal 20 can be used for grounding with the same shell 16, thereby easily performing grounding.

As can be seen from the above description, the electrical connector according to the invention can bring about the following significant effects.

(4) In an electrical connector 10 including a plurality of contacts 14, a housing 12 for arranging and holding said contacts 14, a shell 16 for holding said housing 12, and a ground terminal 20 of a required number or a ground lug 18 of a required number, and said shell 16 and said ground terminal 20 or said ground lug 18 being adapted to be electrically conductive with each other, according to the invention said shell 16 comprises a through-hole 48 communicating with a fitting groove 42 for a mating connector, an installing groove 44 for said housing 12, and a connection portion groove 46, and said through-hole 48 comprises an inserting groove 50 into which said ground terminal 20 is inserted, a screw portion 52 for holding said ground terminal 20, a spacing groove 51 for avoiding any interference with said ground lug 18 integrally mounted on said housing 12, and an engaging portion 53 to engage a locking portion 32 of said housing 12, and further according to the invention both said ground lug 18 and said ground terminal 20 are constructed to become electrically conductive with the same shell 16, respectively, so that grounding is effected by either of said ground lug 18 integrally mounted on said housing 12 and said separately provided ground terminal 20. Therefore, said contacts 14 and said housing 12 can be simply inserted and removed, and a customer or consumer can suitably choose whether one of a required number of contacts 14 or a separate ground terminal 20 is used with the same shell 16, thereby easily performing grounding.

(5) According to the electrical connector 10 as claimed in claim 5, said ground lug 18 and said shell 16 are so constructed that when said housing 12 having said ground lug 18 integrally mounted thereon is inserted into said shell 16 from the side of said connection portion groove 46 to cause said locking portion 32 of said housing 12 to engage said engaging portion 53 of said shell 16, said ground lug 18 and said shell 16 become electrically conductive with each other. Therefore, said contacts 14 and said housing 12 can be simply inserted and removed, and one of a required number of contacts 14 can be used for grounding with the same shell 16, thereby easily performing grounding.

(6) According to the electrical connector 10 as claimed in claim 6, said ground terminal 20 and said shell 16 are so constructed that after said housing 12 is inserted into said shell 16 from the side of said connection portion groove 46 to cause the locking portion 32 of said housing 12 to engage the engaging portion 53 of said shell 16, said ground terminal 20 is inserted into said inserting groove 50 of said shell 16 and a set screw 24 is screwed into said screw portion 52 so that said ground terminal 20 and said shell 16 become electrically conductive with each other. Therefore, said contacts 14 and said housing 12 can be simply inserted and removed, and a separate ground terminal 20 can be used for grounding with the same shell 16, thereby easily performing grounding.

(7) According to the electrical connector 10 as claimed in claim 7, a key 66 having a groove 68 or a raised portion 72 is arranged at the center of a fitting portion of said housing 12, and a key 70 having a raised portion 72 or a groove 68 inversely with the first mentioned key is arranged on a mating connector at a location corresponding to said first mentioned key 66 so that the key 66 of said housing 12 and the key 70 of said mating connector are brought into engagement with each other, thereby preventing an erroneous insertion of the electrical connector 10 into the mating connector. Therefore, with a simple construction, any erroneous insertion when fitting said electrical connector 10 with a mating connector can be prevented, thereby achieving a stable electrical connection between the electrical connector and the mating connector.

(8) According to the electrical connector 10 as claimed in claim 8, said key 66 is held in said housing 12 with the aid of means enabling said groove 66 or said raised portion 72 to be rotated. Consequently, a position of the electrical connector to be fitted with a mating connector can be arbitrarily selected.

The invention will be more fully understood by referring to the following detailed specification and claims taken in connection with the appended drawings.

DESCRIPTION OF THE PREFERRED EMBODIMENTS

Figure 1A:
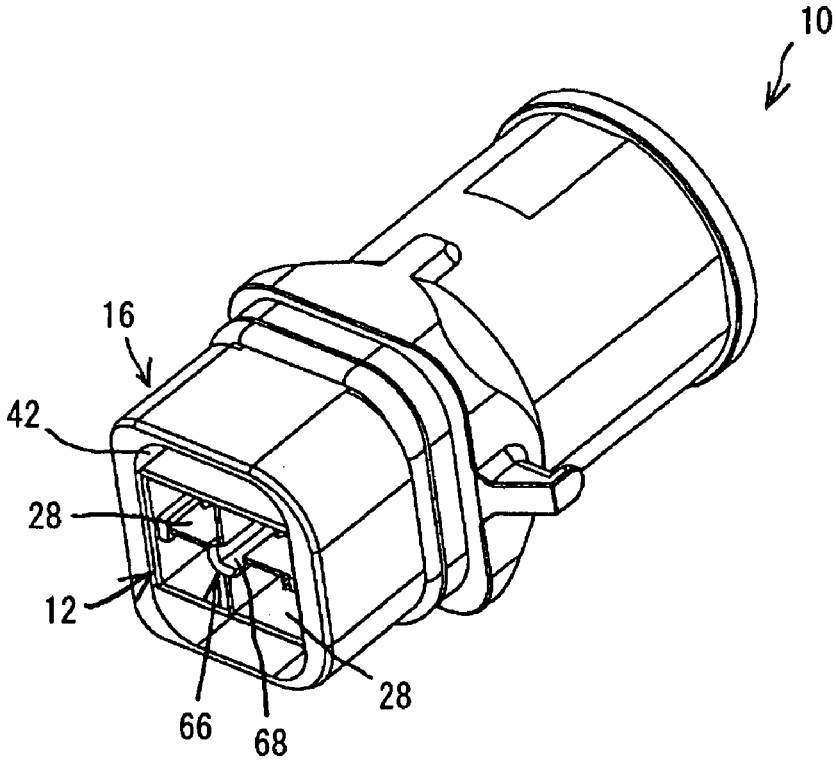
FIG. 1A is a perspective view of the electrical connector according to the invention viewed from its fitting portion.
Figure 1B:
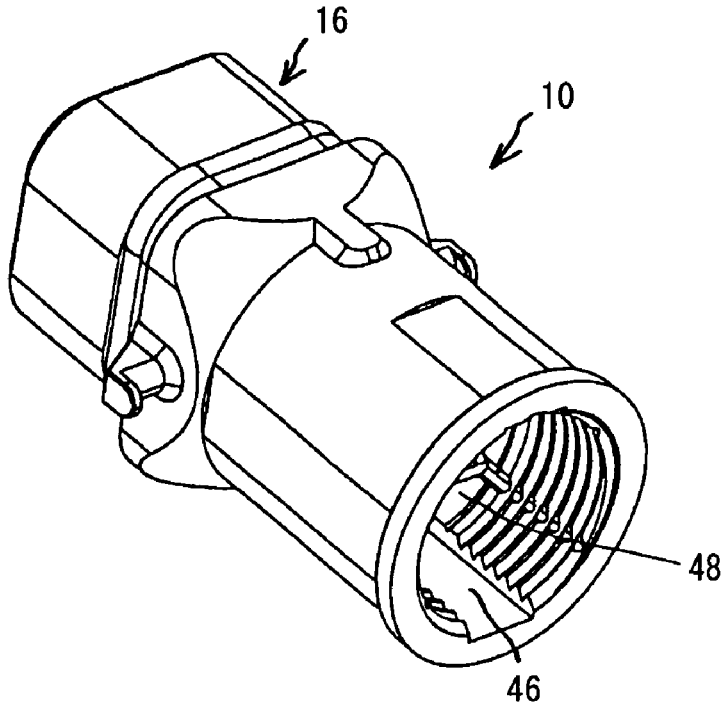
FIG. 1B is a perspective view of the electrical connector according to the invention viewed from its connection portion.
Figure 2A:
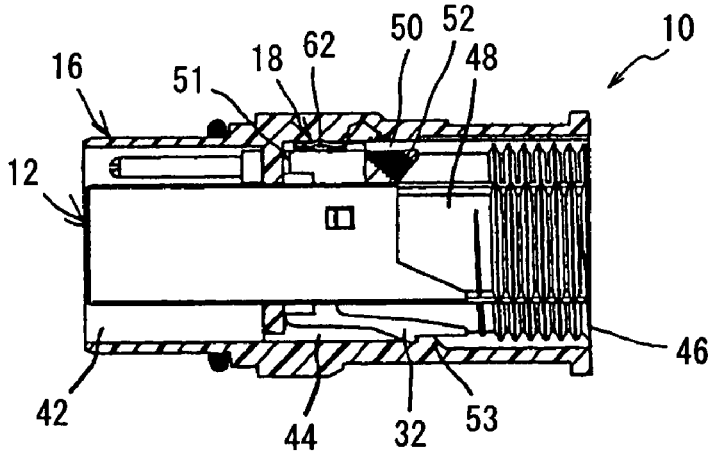
FIG. 2A is a longitudinal-sectional view of the electrical connector using one of contacts for grounding.
Figure 2B:
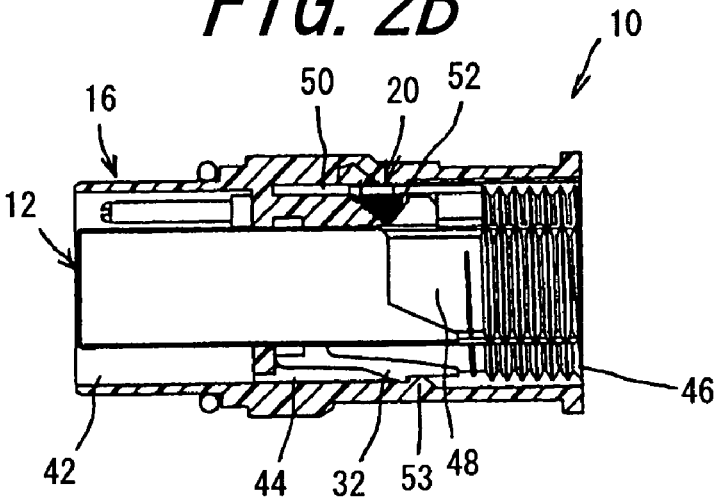
FIG. 2B is a longitudinal-sectional view of the electrical connector using a separate ground terminal for grounding.
Figure 3:
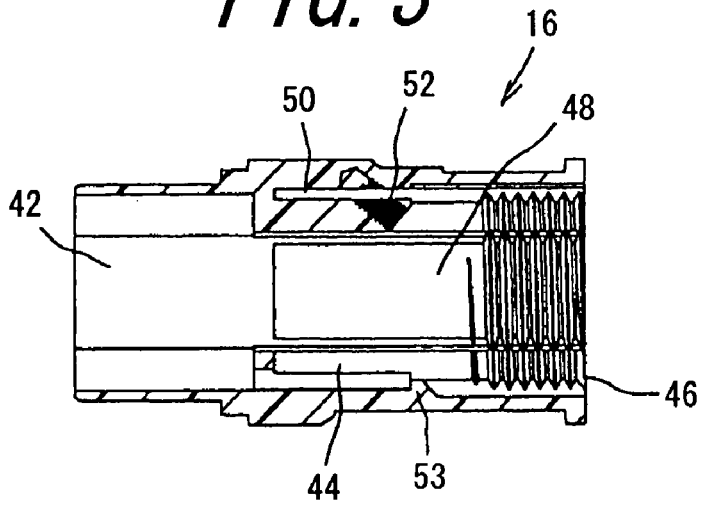
FIG. 3 is a longitudinal-sectional view of a shell.
Figure 4A:
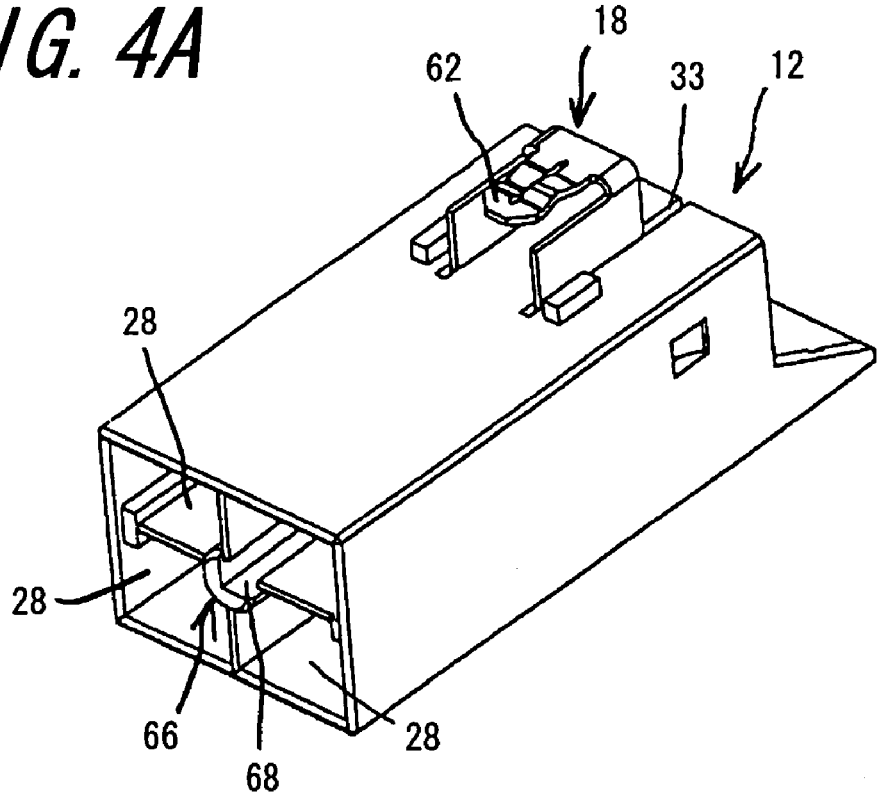
FIG. 4A is a perspective view of a housing having a ground lug.
Figure 4B:
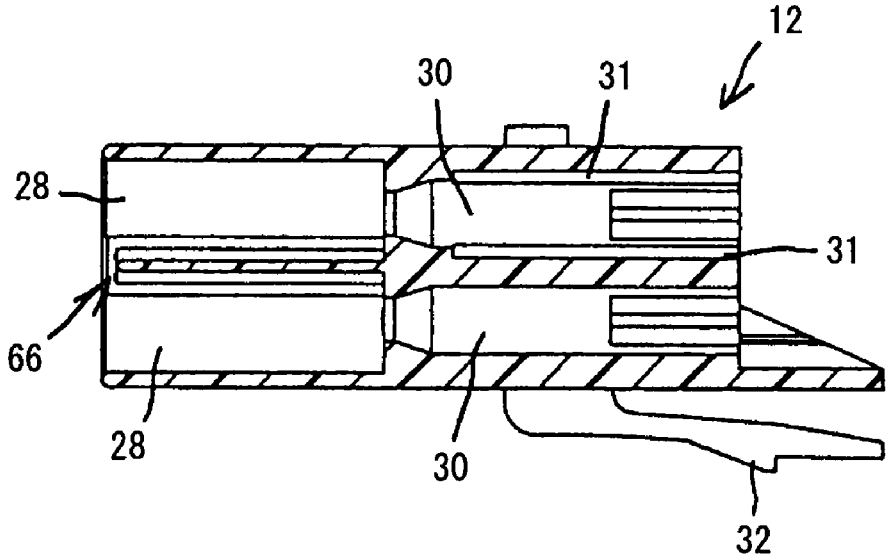
FIG. 4B is a longitudinal-sectional view of the housing of FIG. 4A.
Figure 5A:
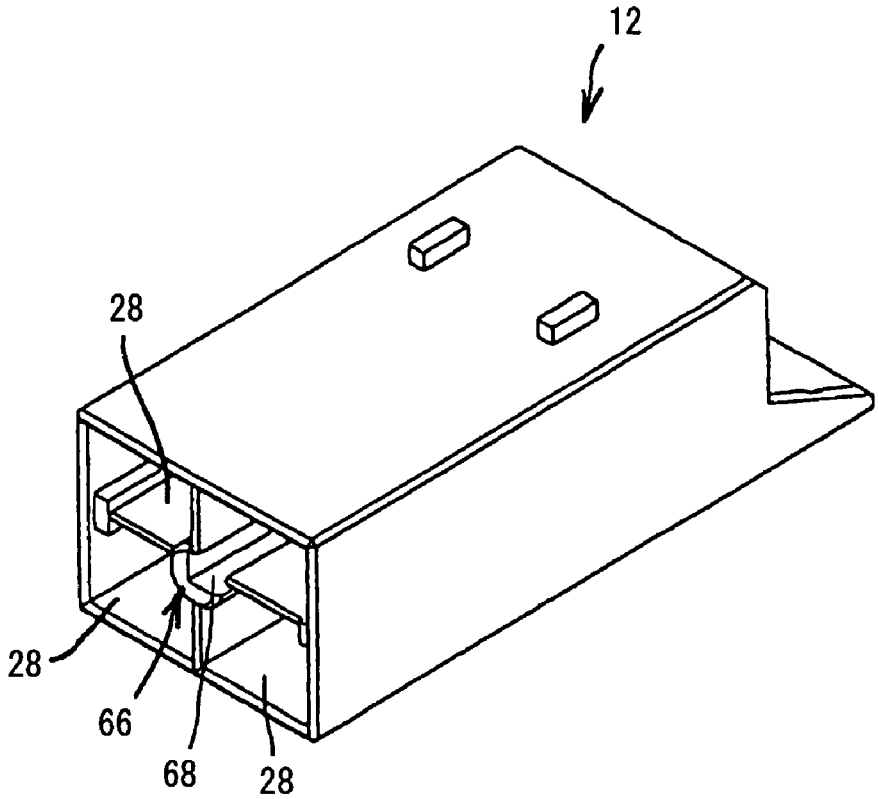
FIG. 5A is a perspective view of the housing not having a ground lug.
Figure 5B:
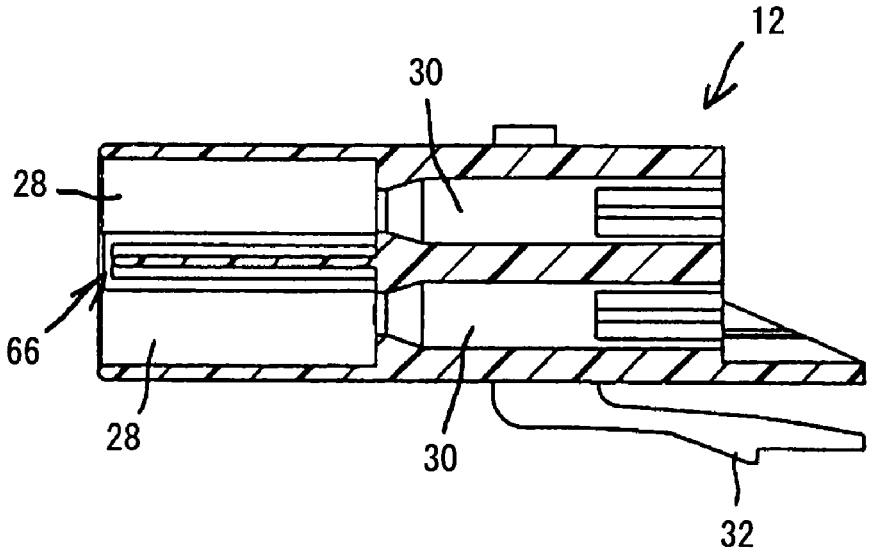
FIG. 5B is a longitudinal-sectional view of the housing in FIG. 5A.
Figure 6:
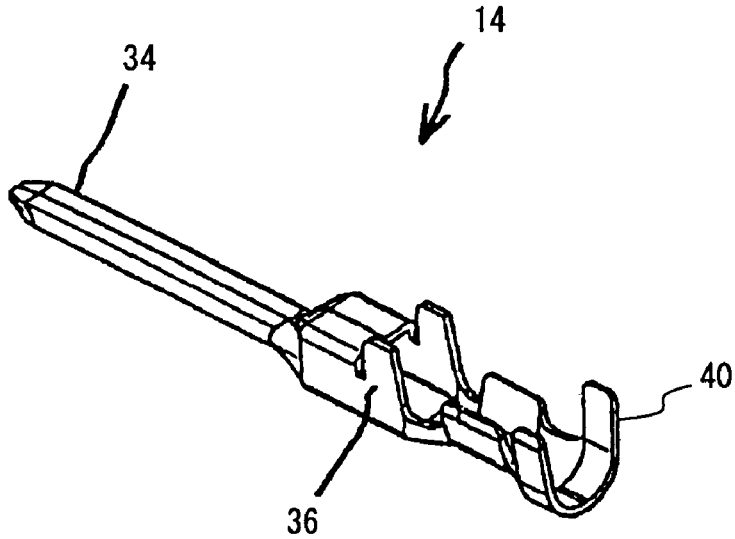
FIG. 6 is a perspective view of a contact.
Figure 7:
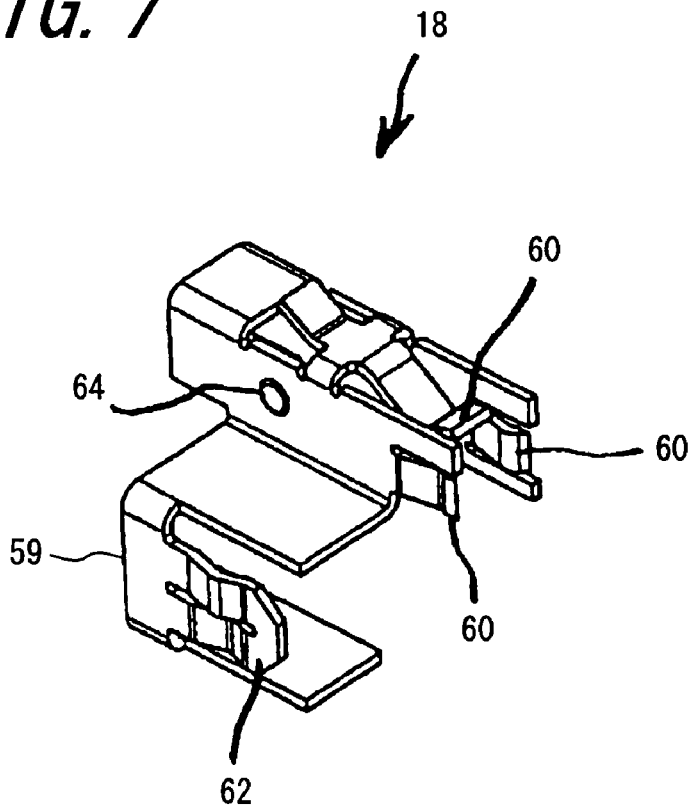
FIG. 7 is a perspective view of a ground lug.
Figure 8:
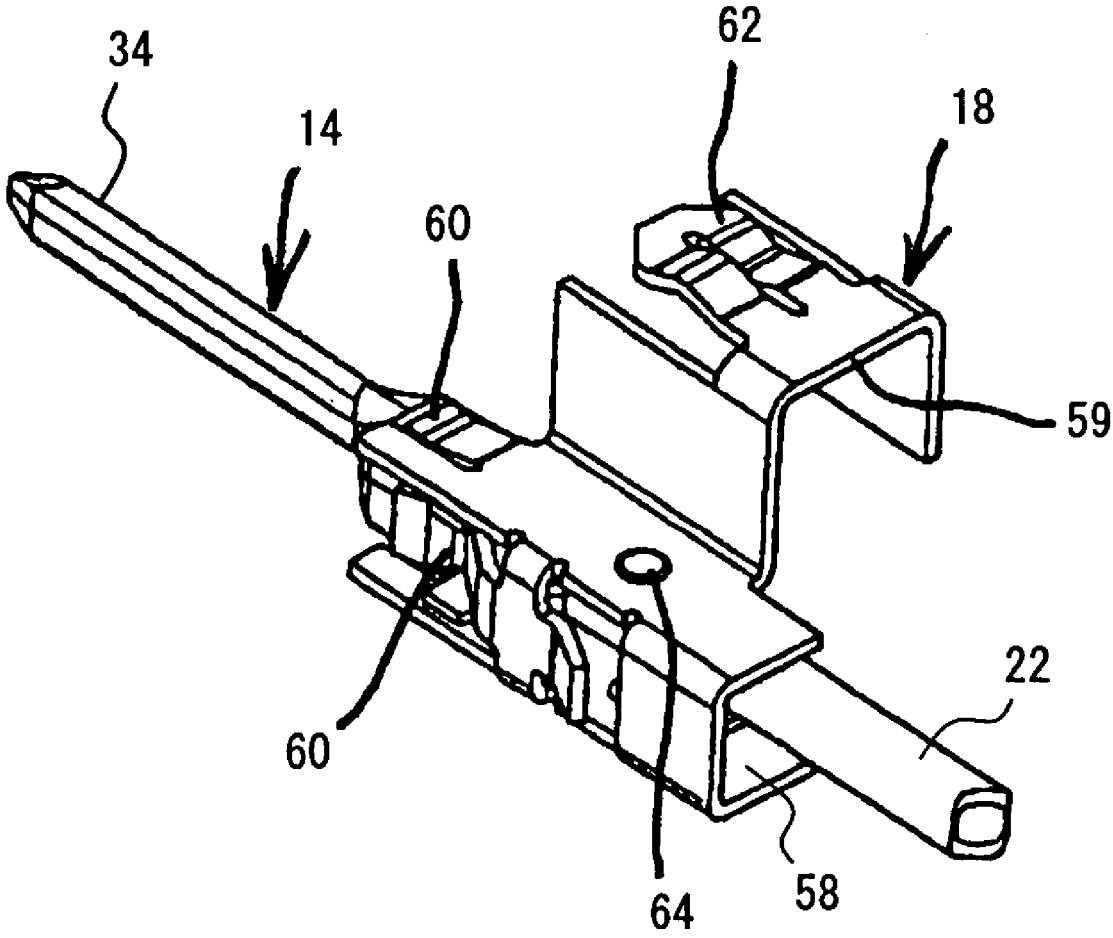
FIG. 8 is a perspective view of a combination of the contact combined with the ground lug.
Figure 9A:
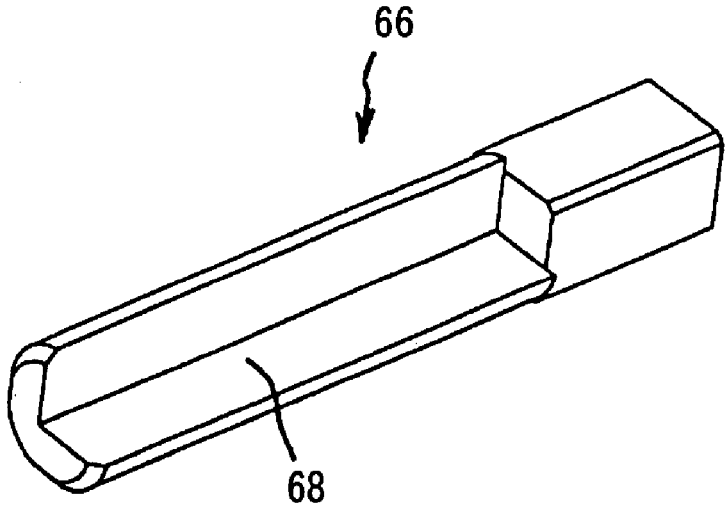
FIG. 9A is a perspective view of a key.
Figure 9B:
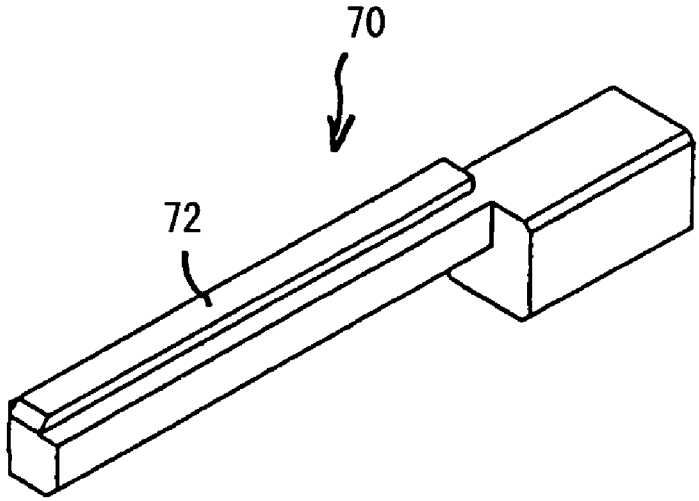
FIG. 9B is a perspective view of another key (mating with the key in FIG. 9A)
Figure 10A:
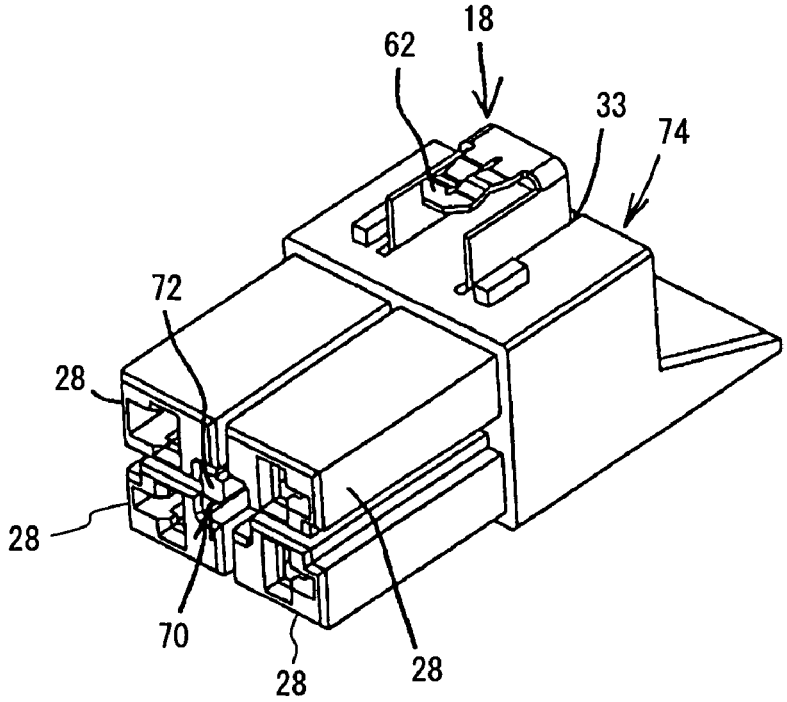
FIG. 10A is a perspective view of another housing having a ground lug.
Figure 10B:
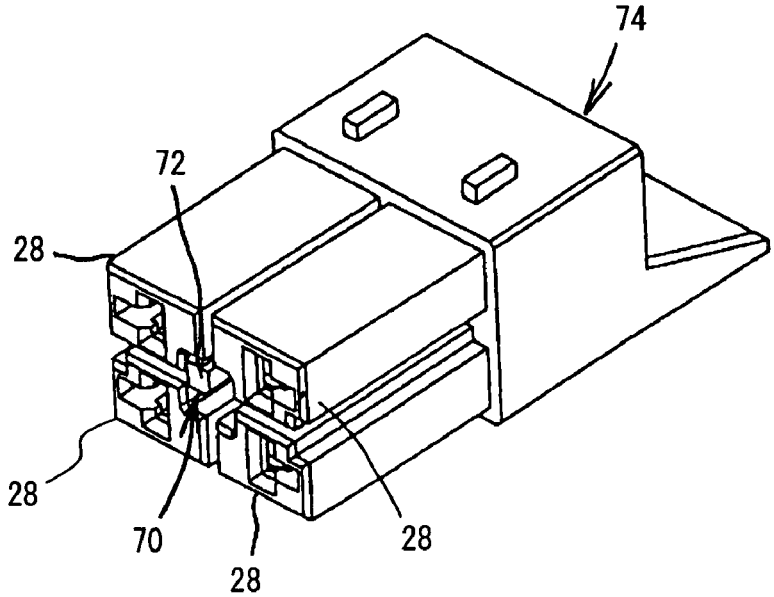
FIG. 10B is a perspective view of another housing not having the ground lug.

The grounding structure according to the invention and the electrical connector using the grounding structure will be explained with reference to FIG. 1A to FIG. 10B. FIG. 1A is a perspective view of the electrical connector viewed from the fitting portion, while FIG. 1B is a perspective view of the electrical connector viewed from the connection portion. FIG. 2A is a longitudinal-sectional view of the electrical connector in the case using one contact for grounding, and FIG. 2B is a longitudinal-sectional view of the electrical connector in the case using a separate ground terminal. FIG. 3 is a longitudinal-sectional view of a shell. FIG. 4A is a perspective view of a housing having a ground lug, while FIG. 4B is a sectional view of the housing. FIG. 5A is a perspective view of a housing not having a ground lug, while FIG. 5B is a sectional view of the housing. FIG. 6 is a perspective view of a contact, and FIG. 7 is a perspective view of a ground lug. FIG. 8 is a perspective view of the contact combined with the ground lug. FIG. 9A is a perspective view of a key, while FIG. 9B is a perspective view of another key (mating with the key in FIG. 9A). FIG. 10A is a perspective view of another housing having a ground lug, and FIG. 10B is a perspective view of a further housing not having a ground lug.

The electrical connector 10 according to the invention at least comprises a housing 12, a plurality of contacts 14, a shell 16, and a ground lug 18 or a ground terminal 20.

First, the grounding structure according to the invention will be explained. The term "grounding structure" is here understood as signifying a structure causing said shell 16 and the ground lug 18 (in more detail, one of said contacts 14 through the ground lug 18) to be electrically conductive or said shell 16 and the ground terminal 20 to be electrically conductive for measure for safety, grounding disposal (shielding disposal) and the like. The important aspect of the grounding structure according to the invention lies in the fact that by providing a shell which can be used for both the ground lug 18 (in more detail one of said contact 14 through the ground lug 18) and ground terminal 20, a consumer or customer can suitably select whether one of a required number of contacts 14 or a separate ground terminal should be used for grounding. The respective grounding structures will be explained after the electrical connector 10 (including the respective components) using the grounding structure has been explained.

First, the shell 16 will be explained which is one subject matter of the invention. Said shell 16 is made of a metal and formed by means of casting. Preferred metals from which to form said shell 16 include a zinc alloy, aluminum alloy and the like formed by die casting which comply with the requirements as to dimensional stability, workability, strength and the like. The shell is substantially cylindrical in the illustrated embodiment.

Said shell 16 is formed with a through-hole 48 communicating with a fitting groove 42 for a mating connector, an installing groove 44 for said housing, and a connection portion groove 46. The through-hole 48 includes an inserting groove 50 for inserting said ground terminal 20, a screw portion 52 for holding said ground terminal 20, a spacing groove 51 for avoiding any interference with said ground lug 18 integrally mounted on said housing 12, and an engaging portion 53 adapted to engage a locking portion 32 of said housing 12.

Said fitting groove 42 receives the mating object and may be suitably designed in consideration of the shape and size of the mating object and the strength and the like of said shell 16. Said installing groove 44 is for installing said housing 12. The size and shape of said installing groove may be suitably designed in consideration of the shape and size of said housing 12 and the strength and the like of said shell 16. Said connection portion groove 46 serves to avoid any interference with said cable 22. The size and shape of the connection portion groove may be suitably designed in consideration of a diameter of the cable 22 and the strength and the like of said shell 16. Said fitting groove 42, the installing groove 44, and the connection portion groove 46 are arranged in this order from the side of insertion of the mating object and communicating with one another to form the through-hole 48.

At the location corresponding to the locking portion 32 of said housing 12 in said installing groove 42, there is provided the engaging portion 53 adapted to engage said locking portion 32. The shape of said engaging portion need only be able to engage said locking portion 32 and may suitably designed in consideration of easy removal of said housing 12 from said shell 16, the strength of said shell 16, the holding power and the like for said housing 12.

On the opposite side of said locking portion 32 in said installing groove 44, moreover, there are provided the spacing groove 51 for avoiding any interference with said ground lug 18 when it is used, the inserting groove 50 for inserting said ground terminal 20 when it is used, and the screw portion 52 into which a set screw 24 is screwed. The size and shape of said spacing groove 51 need only be able to avoid any interference with said ground lug 18, and may be suitably designed in consideration of the shape and size of said ground lug 18, connection between said ground lug 18 and said shell 16, the strength and the like of said shell 16. The size and shape of said inserting groove 50 need only be able to receive said ground terminal 20 and may be suitably designed in consideration of the size and shape of said ground terminal 20, connection between said ground terminal 20 and said shell 16 when said ground terminal 20 is set in the screw portion 52 of said shell 16 by means of said set screw 24, and the strength and the like of said shell 16.

The housing 12 will then be explained. Said housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof.

Said housing is substantially box-shaped and mainly comprises a plurality of inserting holes 30 into which said contacts 14 are inserted, respectively, the locking portion 32 for holding the housing in said shell 16, slits 33 for receiving projections 59 of said ground lug 18, and fitting portions 28 for receiving contacts of the mating object. Each of said fitting portions 28 communicates with each of said inserting holes 30 so that a contact portion 34 of said contact 14 extends into the fitting portion 28.

A hole or groove is formed in each of said inserting holes 30 for hooking or catching lances of each of said contacts 14. The hole or groove may be suitably designed in consideration of hooking of the contacts 14, and the strength and the like of said housing 12.

Said locking portion 32 serves to mount and hold said housing 12 in said shell 16. Said housing 12 is held by said shell 16 by causing said locking portion 32 to engage the engaging portion 53 of said shell 16. By employing such a simple locking system, insertion and removal of said housing 12 into and from said shell 16 can be easily carried out. The shape and size of said locking portion 32 may be suitably designed in consideration of such functions, and springiness, strength, simplicity, and the like of the locking portion 32.

Said slits 33 need only be able to receive the projections 59 of said ground lug 18 and may be suitably designed in consideration of the strength of said housing 12, and insertion and the like of said projections 59.

The contacts 14 will then be explained. Said contacts 14 are made of a metal and formed by means of the press-working of the known technique. Preferred metals from which to form said contacts 14 include brass, beryllium copper, phosphor bronze and the like which comply with the requirements as to springiness, electric conductivity, workability, and the like.

The contacts 14 each mainly comprise a contact portion 34 adapted to contact a mating object, a holding portion 36 to be held in said housing 12, and a connection portion 40 to be connected to a cable 22. The shape and size of said contact portion 34 may be suitably designed in consideration of the mating object. The contact portion 34 is cylindrical in the illustrated embodiment because the mating object is socket-shaped. Said connection portion 40 need only be able to be connected to the cable 22 and may be connected to the cable by press-fitting, pressure welding, soldering, or the like, and is connected to the cable by press-fitting in the illustrated embodiment. Said holding portion 36 may be held by said housing 12 by press-fitting, welding, hooking (lancing) or the like and is held by hooking (lancing) in the illustrated embodiment in order to be easily removed when necessary. In more detail, said housing 12 is formed with holes or grooves, while said contacts are each provided with raised portions (lances) when being worked so that the lances are held in the hole or groove. In this way, said contact 14 can be easily removed from the housing 12 by merely pushing the lances by the use of a simple jig.

The ground lug 18 will then be explained. Said ground lug 18 is made of a metal and formed by means of the press-working of the known technique. Preferred metals from which to form said ground lug 18 include brass, beryllium copper, phosphor bronze and the like which comply with the requirements as to springiness, electric conductivity, workability, and the like. By causing said ground lug 18 to be in contact with said contact 14 and said shell 16, said ground lug 18 brings said contact into electrical conductivity with said shell 16. For this purpose, said ground lug 18 at least comprises a contact inserting hole 58 into which said contact 14 is inserted, a contact-contacting portion 60 for contacting said contact 14, a shell contacting portion 62 for contacting said shell 16, and fixed portions 64 for fixing the ground lug 18 to said housing 12.

Said contact inserting hole 58 has a substantially U-shaped cross-section so as to cover said contact 14. The inner three surfaces of the U-shaped cross-section of the contact inserting hole 58 are each provided with a contact-contacting portion 60 adapted to contact said contact 14. Said contact-contacting portion 60 is curved so as to extend inwardly, thereby enabling the contact-contacting portion to contact said contact 14 easily. By providing said contact-contacting portions 60 on the inner three surfaces of said contact inserting hole 58, said contact 14 is securely embraced by the contact-contacting portions 60 so that the ground lug 18 can be reliably brought into contact with said contact 14. On both outer side surfaces of said contact-contacting hole 58, there are provided the fixing portions 64 for fixing the ground lug 18 to the inserting hole 30 of said housing 12. The ground lug 18 is fixed in the inserting hole 30 by press-fitting in the illustrated embodiment.

Moreover, substantially perpendicularly to said contact inserting hole 58, there is provided a projection 59 having a substantially U-shaped cross-section. The top plate (viewed in FIG. 8) or the vertical plate (viewed in FIG. 7) of the U-shaped projection 59 is provided with a shell contacting portion 62 for contacting said shell 16. Said shell contacting portion 62 is formed at its center with a slit, and the portions on both the sides of the slit are alternately bent inwardly and outwardly for contacting said shell 16.

The ground terminal 20 will then be explained. Said ground terminal 20 is made of a metal and formed by means of the press-working of the known technique. Preferred metals from which to form the ground terminal 20 include brass, beryllium copper, phosphor bronze and the like which comply with the requirements as to electric conductivity, workability, and the like.

The ground terminal 20 mainly includes a hole 54 for receiving the set screw 24 and a pressure bonding portion 56 to be connected to said cable 22. Said hole 54 need only be able to receive the set screw 24, and the size of the hole 54 may be suitably designed in consideration of the strength, workability, connectivity and the like of the ground terminal. Said pressure bonding portion 56 need only be able to be connected to said cable 22. The connection may be performed by pressure bonding, pressure welding, soldering and the like, and the pressure bonding is employed in the illustrated embodiment.

Finally, the respective grounding structures will be explained. At the beginning, the grounding structure using the ground lug 18 will be explained. First, said ground lug 18 is mounted onto said housing 12 by means of press-fitting or the like. Second, said contact 14 connected to said cable 22 is inserted into the inserting hole 30 of said housing 12 so that the contact 14 comes into contact with the contact-contacting portion 60 of said ground lug 18, thereby resulting in the electrical conductivity of said ground lug 18 and said contact 14.

Third, the housing 12 under the above second condition is inserted into said shell 16 from the side of the connection portion groove 46. Upon the insertion, the locking portion 32 of said housing 12 engages the engaging portion 53 of said shell 16 so that said housing 12 is held in said shell 16. When said housing 12 is held in said shell 16 in this way, the shell contacting portion 62 of said ground lug 18 comes in contact with said shell 16, thereby resulting in the electrical conductivity of said ground lug 18 and said shell. In other words, one of the plurality of the contacts 14 becomes electrically conductive with said shell 16 through said ground lug 18.

In the second place, the grounding structure using said ground terminal 20 will be explained. First, said contact 14 connected to said cable 22 is inserted into the inserting hole 30 of said housing 12, and said housing 12 under this condition is inserted into said shell 16 from the side of the connection portion groove 46. Upon the insertion, the locking portion 32 of said housing 12 engages the engaging portion 53 of said shell 16 so that said housing 12 is held in said shell 16. Second, said ground terminal 20 connected to said cable 22 is inserted into the inserting groove 50 of said shell 16 under the above first condition from the side of the connection portion groove 46.

Third, said set screw 24 is inserted into the hole 54 of said ground terminal 20 in the shell 16 under the second condition and screwed into the screw portion 52 of said shell 16. In this way, said ground terminal 20 is held in said shell 16 by said set screw 24 so that said ground terminal 20 becomes electrically conductive with said shell 16.

Needless to say, the two grounding structures described above can be used in a plug-shaped housing and a receptacle-shaped housing, while they can of course be used with male-shaped contacts and female-shaped contacts. The two grounding structures may be suitably selected as the case may be.

In the lattermost description, a key for preventing erroneous insertion will be explained. At the center of the fitting portion of said housing 12 of the electrical connector 10 described above, a key 66 having a groove 68 or a raised portion 72 is arranged. In the illustrated embodiment, the key 66 having a groove 68 shown in FIG. 9A is arranged in the electrical connector 10 as shown in FIG. 1A. Moreover, a key 70 having a raised portion 72 or a groove 68 inversely with the key 66 as shown in FIG. 9B is arranged in a mating connector (not shown) at a location corresponding to said key 66. In other words, the key 70 having the raised portion 72 is arranged in the mating connector to be fitted with the electrical connector 10 in the illustrated embodiment. When said electrical connector 10 is fitted with the mating connector, the groove 68 of said key 66 engages the raised portion 72 of said key 70 to prevent an erroneous insertion.

Moreover, said keys 66 and 70 are held by the respective housings by means which enable the groove 68 or raised portion 72 to be rotated. In this manner, the position of the groove 68 or raised portion 72 relative to the housing is suitably selected so as to limit the position permitting the fitting of the electrical connector 10 and the mating connector.

Other than the housing shown in FIGS. 4A to 5B, a housing as shown in FIGS. 10A and 10B of course can also be applicable to the grounding structures, electrical connectors, and erroneous insertion-preventing key described above. In fact, the housing 12 shown in FIGS. 4A and 4B and 5A and 5B is a plug housing, while the housing 74 shown in FIGS. 10A and 10B is a receptacle housing.

Examples of application are electrical connectors for use in machine tools, robots ad the like, and more particularly to grounding structures enabling either of a ground terminal and a ground lug to be used even with the same shell structure for grounding.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A grounding structure for an electrical connector including a plurality of contacts, a housing for arranging and holding said contacts, a shell for holding said housing, and a ground terminal of a required number or a ground lug of a required number, said grounding structure for causing one of said ground terminal or said ground lug to be in electrical contact with said shell;

wherein said shell comprises a through-hole communicating with a fitting groove for a mating connector, an installing groove for receiving said housing, and a connection portion groove, and said through-hole including an inserting groove into which said ground terminal is inserted, a screw portion for holding said ground terminal, a spacing groove for avoiding any interference with said ground lug integrally mounted on said housing, and an engaging portion to engage a locking portion of said housing; and wherein both said ground lug and said ground terminal are constructed to become electrically conductive with the same shell, respectively, so that grounding is effected by one of said ground lug integrally mounted on said housing and said separately provided ground terminal.

2. The grounding structure as set forth in claim 1, wherein said ground lug and said shell are so constructed that when said housing having said ground lug integrally mounted thereon is inserted into said shell from the side of said connection portion groove to cause said locking portion of said housing to engage said engaging portion of said shell, said ground lug and said shell become electrically conductive with each other.

3. The grounding structure as set forth in claim 1, wherein said ground terminal and said shell are so constructed that after said housing is inserted into said shell from the side of said connection portion groove to cause the locking portion of said housing to engage the engaging portion of said shell, said ground terminal is inserted into said inserting groove of said shell and a set screw is screwed into said screw portion so that said ground terminal and said shell become electrically conductive with each other.

4. An electrical connector including a plurality of contacts, a housing for arranging and holding said contacts, a shell for holding said housing, and a ground terminal of a required number or an ground lug of a required number, and said shell and said ground terminal or said ground lug being configured to be electrically conductive with each other;

wherein said shell comprises a through-hole communicating with a fitting groove for a mating connector, an installing groove for receiving said housing, and a connection portion groove, and said through-hole including an inserting groove into which said ground terminal is inserted, a screw portion for holding said ground terminal, a spacing groove for avoiding any interference with said ground lug integrally mounted on said housing, and an engaging portion to engage a locking portion of said housing; and wherein both said ground lug and said ground terminal are constructed to be electrically conductive with the same shell, respectively, so that grounding is effected by one of said ground lug integrally mounted on said housing and said separately provided ground terminal.

5. The electrical connector as set forth in claim 4 wherein said ground lug and said shell are so constructed that when said housing having said ground lug integrally mounted thereon is inserted into said shell from the side of said connection portion groove to cause said locking portion of said housing to engage said engaging portion of said shell, said ground lug and said shell become electrically conductive with each other.

6. The electrical connector as set forth in claim 4 wherein said ground terminal and said shell are so constructed that after said housing is inserted into said shell from the side of said connection portion groove to cause the locking portion of said housing to engage in the engaging portion of said shell, said ground terminal is inserted into said inserting groove of said shell and a set screw is screwed into said screw portion so that said ground terminal and said shell become electrically conductive with each other.

7. The electrical connector as set forth in claim 4, wherein a key having a groove or a raised portion is arranged at the center of a fitting portion of said housing, and a key having a raised portion or a groove inversely with the first mentioned key is arranged on a mating connector at a location corresponding to said first mentioned key so that they key of said housing and the key of said mating connector are brought into engagement with each other, thereby preventing an erroneous insertion of the electrical connector into the mating connector.

8. The electrical connector as set forth in 7, wherein said key is held in said housing with the aid of means enabling said groove or said raised portion to be rotated.

* * * * *